US007198217B2

(12) United States Patent
Gildersleeve et al.

(10) Patent No.: US 7,198,217 B2
(45) Date of Patent: Apr. 3, 2007

(54) APPARATUS FOR TUMBLING CONCRETE PRODUCTS

(75) Inventors: Stacy L. Gildersleeve, Vancouver, WA (US); Tomas A. Glascoe, Vancouver, WA (US)

(73) Assignee: Columbia Machine, Inc., Vancouver, WA (US)

( * ) Notice: Subject to any disclaimer, the term of this patent is extended or adjusted under 35 U.S.C. 154(b) by 46 days.

(21) Appl. No.: 11/141,731

(22) Filed: May 31, 2005

(65) Prior Publication Data

US 2005/0218252 A1 Oct. 6, 2005

Related U.S. Application Data

(62) Division of application No. 10/269,377, filed on Oct. 10, 2002, now Pat. No. 6,913,215.

(51) Int. Cl.
*B02C 19/00* (2006.01)

(52) U.S. Cl. ..... 241/299; 241/300

(58) Field of Classification Search ..... 241/182, 241/183, 300, DIG. 30, 299
See application file for complete search history.

(56) References Cited

U.S. PATENT DOCUMENTS 3,378,209 A * 4/1968 Crocheron ..... 241/102
3,981,117 A 9/1976 Dehlen
4,293,014 A * 10/1981 Lundmark ..... 144/208.9
4,319,719 A * 3/1982 Larsen ..... 241/183
4,424,938 A * 1/1984 Day ..... 241/182
4,655,602 A 4/1987 Tomlinson
5,302,017 A 4/1994 Platek et al.
5,716,013 A 2/1998 Benson et al.
5,839,490 A 11/1998 Kiedaisch et al.
5,942,181 A 8/1999 Rondeau
6,109,906 A 8/2000 Castonguay et al.
6,390,401 B1 5/2002 Sellars

* cited by examiner

*Primary Examiner*—Mark Rosenbaum
(74) *Attorney, Agent, or Firm*—Marger Johnson & McCollom, PC

(57) ABSTRACT

A tumbler for tumbling concrete products comprises a rotatable cylindrical drum having an input end that is slightly elevated relative to an output end. Tire retread strips are placed side-by-side on the radially inner surface of the drum and extend along its length. Clamps having lateral arms extending on either side are engaged with lateral tread grooves on the strips. The clamps are bolted to the drum between adjacent strips thereby securing the strips to the radially inner surface of the drum.

7 Claims, 4 Drawing Sheets

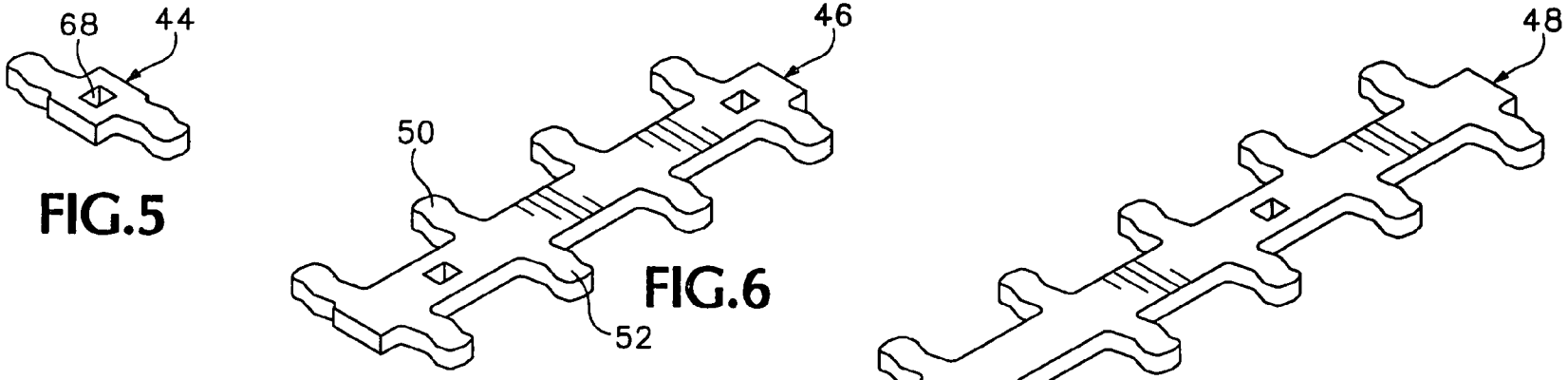
FIG.5
FIG.6
FIG.7
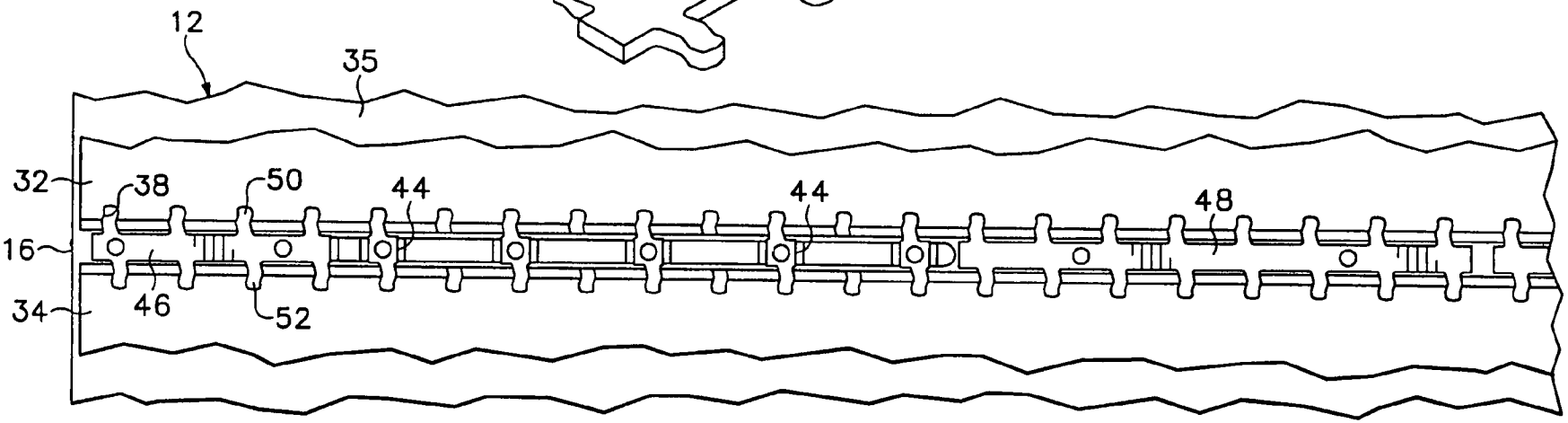
FIG.8

APPARATUS FOR TUMBLING CONCRETE PRODUCTS

This application is a division of prior application Ser. No. 10/269,377, filed Oct. 10, 2002, now U.S. Pat. No. 6,913, 215, issued Jul. 5, 2005.

BACKGROUND OF THE INVENTION

1. Field of the Invention

The present invention relates to methods and apparatus for tumbling concrete products and more particularly to such methods and apparatus in which concrete products are tumbled in a drum having an elastic liner.

2. Background of the Invention

It is known to provide a textured surface for concrete products, such as concrete blocks, by putting the blocks in a cylindrical drum having an elastic liner and rotating the drum. This chips the surface and provides a desirable textured appearance. The drum typically includes an input end that is elevated slightly relative to an output end. As a result, the blocks move toward the lower output end of the drum where they emerge, ready for shipping. While moving down the drum, the blocks tumble against one another, thus chipping the blocks.

The elastic liner is a suitable elastic material such as rubber. In one prior art tumbler, coaxial ribs, each including a cylindrical inner surface, are positioned adjacent one another along the length of the drum. A rubber strip is bolted to and covers each rib. The bolts are received through holes bored in the rubber and corresponding bores in the ribs. When the rubber is worn out, the bolts are removed, bores are drilled in new rubber strips, and the new rubber strips are bolted onto the ribs.

In another prior art drum, tire retread strips are placed on the radially inner drum surface parallel to the longitudinal axis. The strips are secured to the drum by bolts received in bores drilled through the strips and corresponding drum bores. As in the other prior art tumbler, when the tire retread strips are worn out, they are unbolted and bores are drilled into new retread strips in alignment with the mounting bores in the drum. The new strips are then bolted to the drum.

These prior art tumblers suffer from several disadvantages. First, there are many bolts that must be dealt with individually both in removing the worn strips and when installing new strips. Second, it is necessary to drill bores in the new rubber strips to accommodate the bolts that secure them. Drilling rubber is difficult and time-consuming. Finally, in these prior art tumblers, the head of each bolt is fully exposed above the surface of the rubber. As a result, the tumbling blocks frequently strike bolt heads, which tends to knock off the galvanizing.

BRIEF DESCRIPTION OF THE DRAWINGS

FIGS. 5, 6 and 7 depict short, medium, and long clamps used to clamp tire tread to the radially inner surface of the tumbler drum.

FIG. 8 is a view of the output end of the radially inner surface of the tumbler with portions of tire tread and tumbler drum broken away.

DETAILED DESCRIPTION OF THE PREFERRED EMBODIMENT

Figure 1:
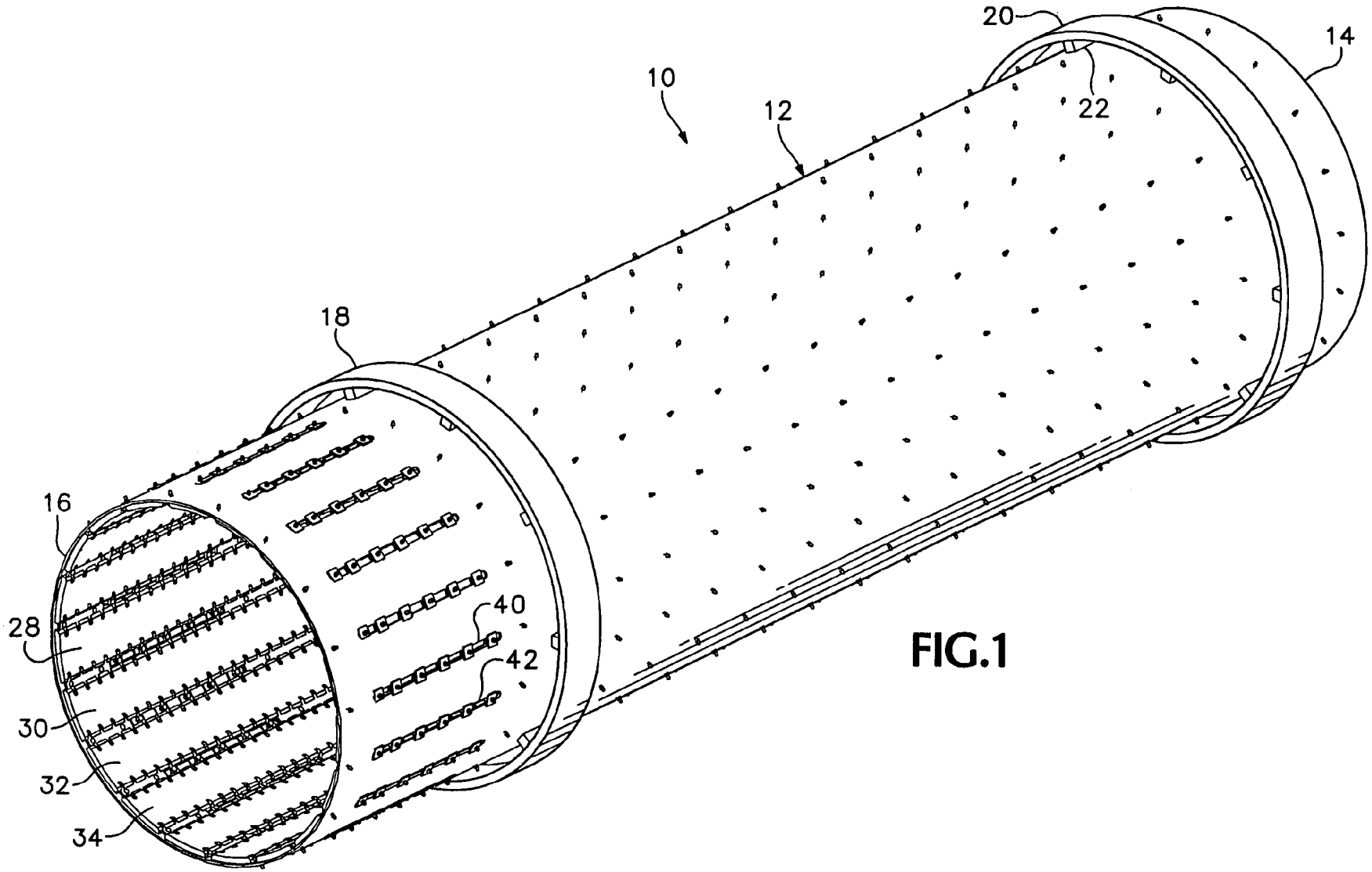
FIG. 1 is a perspective view of a portion of a tumbler constructed in accordance with the present invention.

Turning to FIG. 1, indicated generally at 10, is a tumbler for tumbling concrete products constructed in accordance with the present invention. Tumbler 10 includes a cylindrical metal drum 12 having an input end 14 and an output end 16.

A pair of roller rings 18, 20 are mounted on drum 12 coaxially therewith. The rings are mounted on ring support elements, like roller ring 20 is mounted on element 22 in FIG. 1. Elements 24, 26, upon which ring 18 is mounted, are viewable in FIG. 4.

Roller rings 18, 20 are supported by conventional drive wheels (not shown) on a conventional drive mechanism for rotating drum 12, as will later be more fully described in connection with the operation of tumbler 10.

Tire-tread strips, four of which are strips 28, 30, 32, 34, are mounted on the radially inner surface 35 of drum 12. These strips are also referred to herein as elastic strips. Strips 28, 30, 32, 34 are also visible in FIG. 2. These strips are commercially available and are used to retread tires. But the product is usually not in lengths as long as drum 12, which is approximately 20 feet. The suppliers of these strips, however, can provide custom lengths by vulcanizing pieces together. As a result, in the present embodiment of the invention, each strip extends along the entire length of drum 12.

Figure 2:
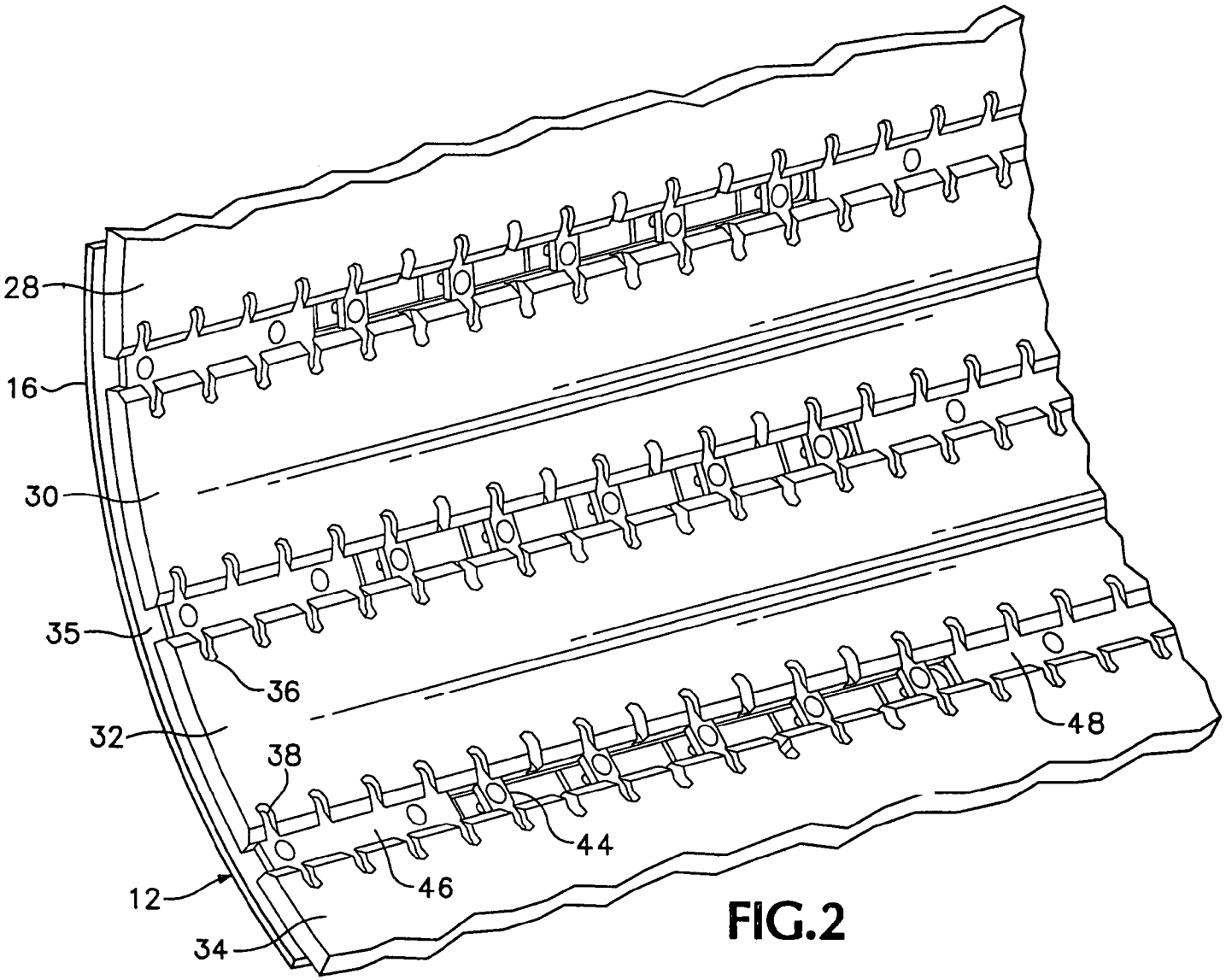
FIG. 2 is an enlarged partial view of an inner surface of the output end of the tumbler of FIG. 1.

The tire tread strips, like strip 32 in FIG. 2, include lateral tread grooves, like grooves 36, 38. As can be seen in FIG. 2, these grooves are longitudinally offset one from the other, i.e., they are not directly opposite one another. Although each of the strips, like strip 32, includes circumferential grooves, these are not shown for the sake of clarity in the drawings.

Turning again back to FIG. 1, longitudinal debris slots, like slots 40, 42 are formed adjacent output end 16 of drum 12. These slots are parallel to the longitudinal drum axis and are evenly spaced about the circumference of the drum as shown in the preferred embodiment.

Strips 28, 30, 32, 34 are secured to drum 12 via clamps, which are of three different sizes: small, like clamp 44 in FIG. 2; medium, like clamp 46 in FIG. 2; and large, like clamp 48, which is partially broken away in the FIG. 2 view. These clamps are each illustrated in FIGS. 5, 6, and 7, respectively, and are also depicted in FIG. 8. As can be seen in FIGS. 5–7, each of the clamps has lateral arms or lugs, like lugs 50, 52, on clamp 46, that extend from a central clamp body. As can be seen in FIG. 8, these lugs are laterally offset in the same fashion as lateral tire grooves, like grooves 36, 38 on tread 32 in FIG. 2. As a result, the ends of each tread strip, like the leftmost end of strips 32, 34 in FIG. 8, can be placed adjacent one end of the drum, and the offset lugs in each of the clamps can be received within lateral tread grooves on adjacent tire strips.

Figure 3:
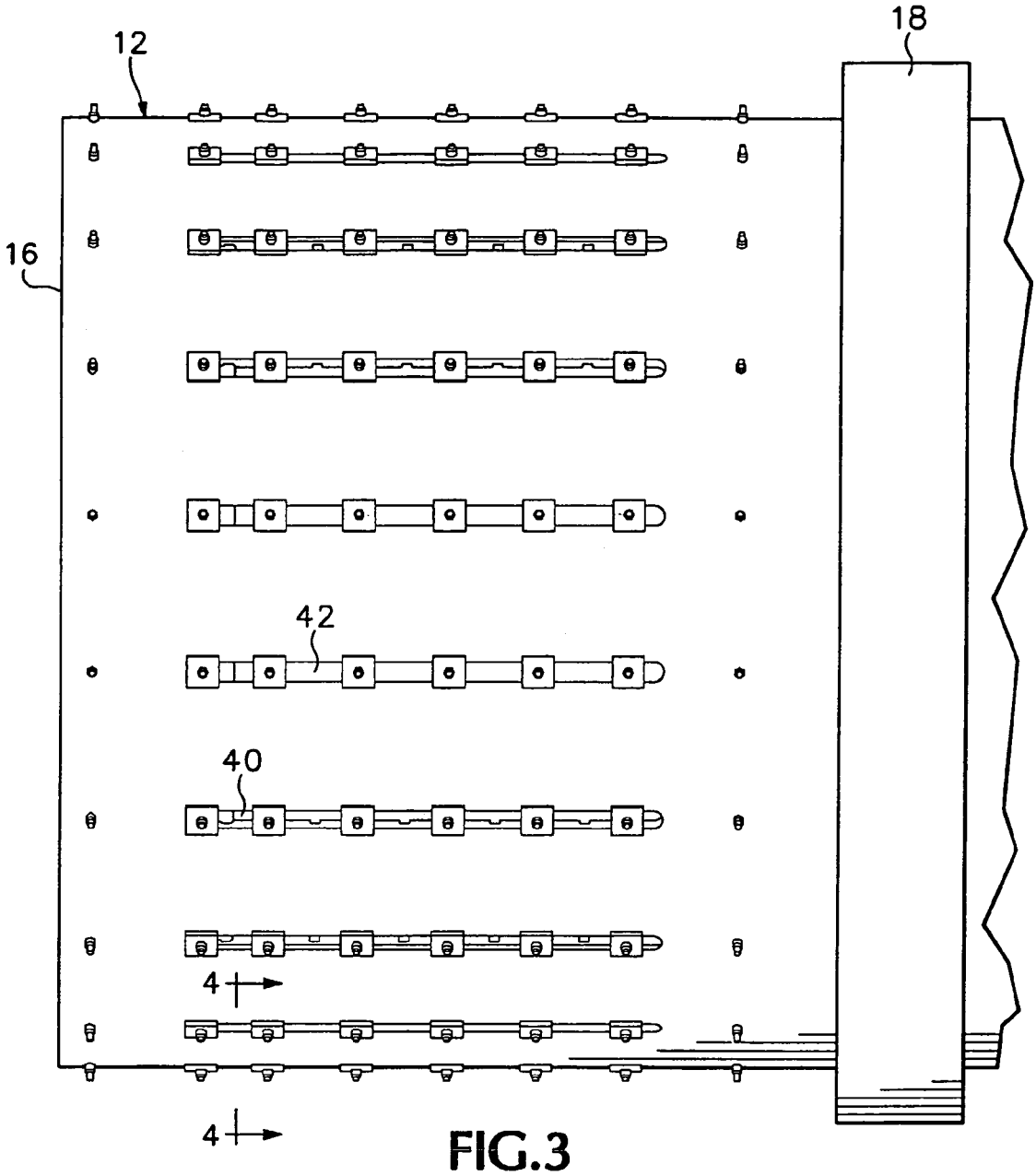
FIG. 3 is a side elevation view of the output end of the tumbler of FIG. 1.
Figure 4:
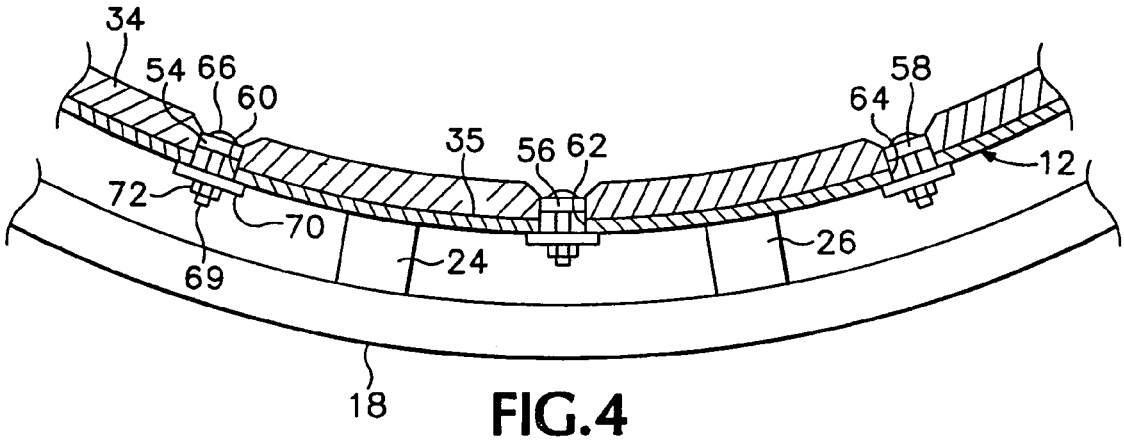
FIG. 4 is an enlarged partial cross-sectional view taken along line 4—4 in FIG. 3.

These clamps are secured as shown in FIGS. 3 and 4. First, with reference to the small clamps, like clamp 44, small clamps 54, 56, 58 have their lateral lugs (not visible in FIG. 4) received within lateral tire grooves in the same fashion that the lugs on clamp 44 in FIG. 8 are so received. These small clamps are used to secure tire tread edges that are adjacent the slots, like slots 40, 42 in FIG. 3. For example, small clamps 54, 56, 58 are associated with slots 60, 62, 64, respectively, in FIG. 4. A commercially available bolt, like bolt 66 associated with clamp 54, secures each of the small clamps to drum 12. Bolt 66 is of the type having a square cross-section that extends from beneath the flat underside of the bolt head. This square cross-section is obscured because it is received within a square opening, like opening 68 in clamp 44 (FIG. 5). The bolt is therefore secured against rotation in opening 68.

A threaded lower end 69 of bolt 66, in FIG. 4, is received through slot 60. A square washer 70 is received over threaded bolt end 69 and a nylon nut 72 is threadably engaged with bolt end 69 and tightened. As a result, the arms on clamp 54 are pulled well into the lateral tire grooves, like grooves 36, 38 in FIG. 2. These arms clamp the adjacent tread strips firmly against the radially inner surface 35 of drum 12 thereby securing them in place.

Each of the other clamps secure adjacent treads in a similar fashion. The other clamps, namely the medium and large clamps, however, are not mounted adjacent the slots, like slots 40, 42. Although these medium and large clamps are secured using bolts, like bolt 66, the bolts are received through an unthreaded bore through drum 12. A plurality bolt ends are seen extending through these bores in drum 12 from between the debris slots, like slots 40, 42 in FIG. 1 to input end 14 of the drum. In the present embodiment of the invention, large clamps, like clamp 48, are placed end to end between input end 14 and the debris slots and are bolted into position using the bolts as shown. For the large clamps, it is not necessary to provide a washer between the nylon nut and the radially outer surface of drum 12. Rather, the nut is simply tightened against the surface of the drum.

A single medium clamp is used between each debris slot and output end 16 of the drum. As can be seen in FIG. 3, the end of each medium clamp toward the debris slot is secured at one end of the debris slot using a square washer in the same fashion as each of the small clamps are secured in the slot. The end of the medium clamp toward output end 16, however, is secured like each of the large clamps, i.e., with the bolt received in a bore and without a washer between the nylon nut and the radially outer surface of the drum.

This configuration leaves openings between each of the small clamps through which debris falls as the drum rotates and the product is tumbled.

When the tire treads become worn out, the clamps are unbolted and the worn treads removed. New treads are then positioned inside the drum and the clamps re-attached as shown in the drawings. This system provides several advantages. Among these are use of fewer bolted connections than prior art tumblers, no drilling of rubber, and more protection for each of the bolt heads and the associated clamps. This protection results from placing the bolt heads and clamps beneath the radially innermost surface of each of the tire strips (shown in FIG. 4), as opposed to mounting a bolt or clamp on the surface of the tire strip. As a result, tumbling concrete products may from time to time land on the bolt heads and clamps. But the bolt heads and clamps are somewhat protected because they are received between adjacent tire strips and pulled down beneath the upper surface of the tire strips, as shown in FIG. 4.

Having described and illustrated the principles of the invention in a preferred embodiment thereof, it should be apparent that the invention can be modified in arrangement and detail without departing from such principles. I claim all modifications and variation coming within the spirit and scope of the following claims.

The invention claimed is:

1. Apparatus for tumbling concrete products comprising:

a drum having an input end, an output end, and an inner surface;

a plurality of elastic strips comprising tire tread positioned adjacent one another on said inner surface;

a plurality of clamps positioned between pairs of said strips, the clamps including arms extending laterally therefrom on either side of the clamp, the arms being constructed to engage a tread groove in the tire tread; and a locking mechanism that urges each clamp against its associated strip pair thereby securing the strips to the drum.

2. The apparatus of claim 1 wherein said drum has a longitudinal axis and wherein said strips are oriented substantially parallel to the longitudinal axis.

3. The apparatus of claim 2 wherein each of said strips comprises a single piece that extends substantially between said input end and said output end.

4. The apparatus of claim 1 wherein said locking mechanism comprises a bolt and wherein said clamps include an opening for receiving said bolt therethrough.

5. The apparatus of claim 4 wherein said drum has a longitudinal axis and wherein said strips are oriented substantially parallel to the longitudinal axis.

6. Apparatus for tumbling concrete products comprising:

a substantially cylindrical drum, said drum having an input end for receiving concrete products and an output end that is lower than the input end when said drum is in its operable condition;

a plurality of elongate tread rubber strips each being substantially the length of said drum;

a plurality of clamps, each having lateral arms on opposite sides thereof, said arms being engagable with tread grooves when said clamp is positioned between a pair of said tread rubber strips;

a plurality of bores formed in said drum between said input end and said output end;

a plurality of bolts receivable in said threaded bores;

a plurality of bores formed in said clamps for receiving said bolts therethrough, said bolts clamping said tread rubber strips to the radially inner surface of said drum when said strips are arranged on said surface, said arms are engaged with the tread grooves and said bolts are received in said clamp bores and threadably engaged with a nut.

7. The apparatus of claim 6 wherein said apparatus further includes a drive mechanism operably engaged with said drum for rotating it about the longitudinal axis thereof.

* * * * *

UNITED STATES PATENT AND TRADEMARK OFFICE

CERTIFICATE OF CORRECTION

PATENT NO. : 7,198,217 B2
APPLICATION NO. : 11/141731
DATED : April 3, 2007
INVENTOR(S) : Gildersleeve et al.

It is certified that error appears in the above-identified patent and that said Letters Patent is hereby corrected as shown below:

On the title page, Item [75]: Inventors: "Tomas A. Glascoe" should read -- Thomas A. Glascoe--.

Signed and Sealed this

Sixth Day of November, 2007

JON W. DUDAS
*Director of the United States Patent and Trademark Office*